US005568897A

United States Patent [19]

Menegatto

[11] Patent Number: 5,568,897

[45] Date of Patent: Oct. 29, 1996

[54] CUTTER FOR CUTTING YARN IN TEXTILE MACHINES

[75] Inventor: Carlo Menegatto, Monza, Italy

[73] Assignee: Menegatto S.r.l., Milan, Italy

[21] Appl. No.: 363,525

[22] Filed: Dec. 23, 1994

[30] Foreign Application Priority Data

Dec. 24, 1993 [IT] Italy ..... MI93A2732

[51] Int. Cl.[6] ..... B65H 54/71; B65H 75/32

[52] U.S. Cl. ..... 242/19; 83/950

[58] Field of Search ..... 242/19, 18 EW, 242/18 PW, 18 A; 83/913, 950

[56] References Cited

U.S. PATENT DOCUMENTS

| | | | |
|---|---|---|---|
| 2,772,054 | 11/1956 | Herele et al. | 242/19 |
| 3,380,676 | 4/1968 | Jenny | 242/19 |
| 3,792,818 | 2/1974 | Bauer et al. | 242/18 PW |
| 3,816,990 | 6/1974 | Hoffmann et al. | 242/19 X |
| 3,964,721 | 6/1976 | Owens et al. | 242/18 PW |
| 4,537,107 | 8/1985 | Armstrong et al. | 83/913 X |
| 4,630,782 | 12/1986 | Rohner | 242/18 EW |
| 4,856,722 | 8/1989 | Horsey et al. | 242/18 A |
| 5,348,242 | 9/1994 | Bauer et al. | 242/19 X |

FOREIGN PATENT DOCUMENTS

| | | |
|---|---|---|
| 0565899 | 10/1993 | European Pat. Off. . |
| 2581399 | 11/1986 | France . |
| 1560453 | 8/1971 | Germany . |

*Primary Examiner*—Michael R. Mansen
*Attorney, Agent, or Firm*—Young & Thompson

[57] ABSTRACT

Cutter for cutting yarn in oscillating motion in textile machines, which comprises a first upper mobile cutting element, a second lower fixed cutting element cooperating with the first cutting element in the cutting of yarn, a stem for supporting the first mobile cutting element and a driver for the stem acting to drive the movement of the first mobile cutting element upwards, away from the second fixed cutting element and downwards, towards and against the second fixed cutting element in order to cut the yarn. the stem supports and drives the mobile part and in the raised position forms a part for interception of the yarn in oscillating motion.

8 Claims, 3 Drawing Sheets

CUTTER FOR CUTTING YARN IN TEXTILE MACHINES

BACKGROUND OF THE INVENTION

The present invention relates to a cutter for cutting yarn in oscillating motion in textile machines.

It is known that in textile machines the performance of certain operations requires the yarn to be drawn by suitable parts in reciprocating motion which make it move in an oscillating or waving manner.

It is likewise known that, in some situations, for example in the automatic change of reels in an automatic winding textile machine, it is necessary to cut such a yarn in oscillating motion by means of automatically driven pads in order to interrupt its feed towards a reel which has completed filling.

Known devices, which perform this operation of cutting yarn in oscillating or waving motion, have various disadvantages including that of cutting the yarn only if the latter arrives from a well-defined part of the cutting device, so that, if these known devices are actuated at the moment when the yarn is on the opposite side, not suitable for shearing, in order to cut said yarn it is necessary to wait until the latter goes back and is arranged in the direction suitable for shearing.

This delayed intervention by the shearing device involves the risk that the yarn not sheared in time can become tangled up in parts of the textile machine, making it inoperative. Moreover it always entails a waste of time which slows down subsequent operations of the textile machine.

Other disadvantages of known devices consist of the fact that they often have a structure which is too complex and the fact that they are not always able to perform cutting operations reliably.

In some known cutting devices the cutting blades may in fact close ineffectively on cutting the yarn, for example leaving gaps between the closed and touching cutting edges, inside whereof the yarn may be deposited and hence not cut.

In other cases known cutting devices do not have suitable elements for intercepting the yarn in a waving movement so that said yarn may wind around the non-cutting elements of the device and make cutting impossible.

The object of the present invention is that of providing a cutter for cutting yarn in oscillating motion in textile machines with which it is possible to achieve a high intervention speed, that is to say a cutter for cutting a yarn which is able to intervene on an oscillating yarn which comes from both sides of the cutter.

Another object of the present invention is that of providing a cutter for cutting a yarn in textile machines thanks to which the cutting operation is performed reliably, without the possibility of failures of the device.

A further object of the present invention is that of providing a cutter for cutting a yarn in textile machines which is simple in structure and can easily be positioned and assembled on the textile machine whereon it is fitted.

SUMMARY OF THE INVENTION

The previous objects are achieved with a cutter for cutting yarn in oscillating motion comprising a first upper mobile cutting element, a second lower fixed cutting element cooperating with said first cutting element to cut the yarn, a stem for supporting said first cutting element which extends below said first cutting element with the latter which extends radially to said stem, means for driving the stem which act to cause the movement of said first mobile cutting element upwards, away from said second fixed cutting element, and downwards towards and against said second fixed cutting element to cut the yarn, with said stem for supporting and driving said mobile element which in the raised position extends further upwards than said lower fixed cutting element and defines a part for intercepting the yarn in oscillating motion.

With this type of cutter it is possible to intercept, by means of said central stem, yarn coming from both sides of the cutter as well as to cut said yarn rapidly and reliably by a rapid downward movement of the upper cutting element towards and against the lower fixed cutting element.

BRIEF DESCRIPTION OF DRAWINGS

Further features and advantages of the present invention will be made clearer on reading the following description relating to a preferred embodiment. The description must be read with reference to the accompanying drawings in which.

DESCRIPTION OF THE PREFERRED EMBODIMENT OF THE INVENTION

Figure 1:
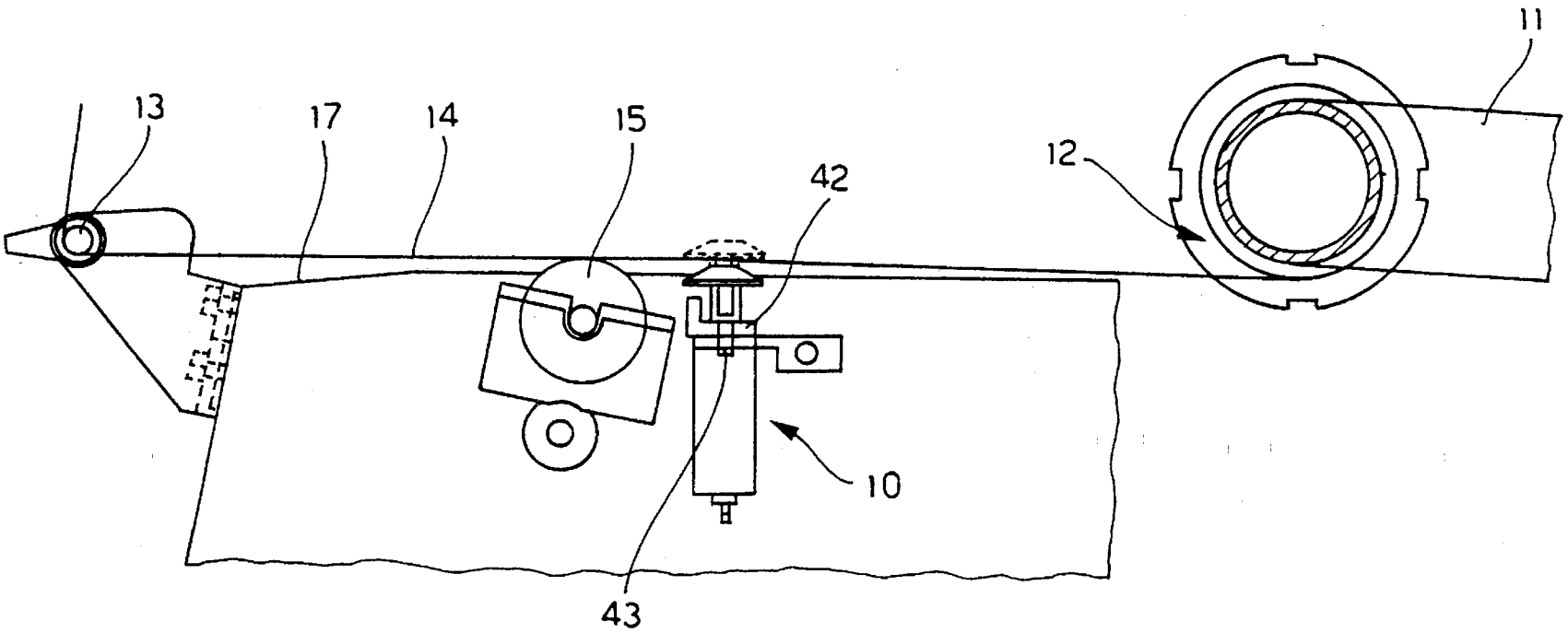
FIG. 1 represents a side view of a textile machine whereto the cutter of the present invention is applied.

In the figures, for convenience of description, the same elements are denoted by the same reference numerals.

Figure 2:
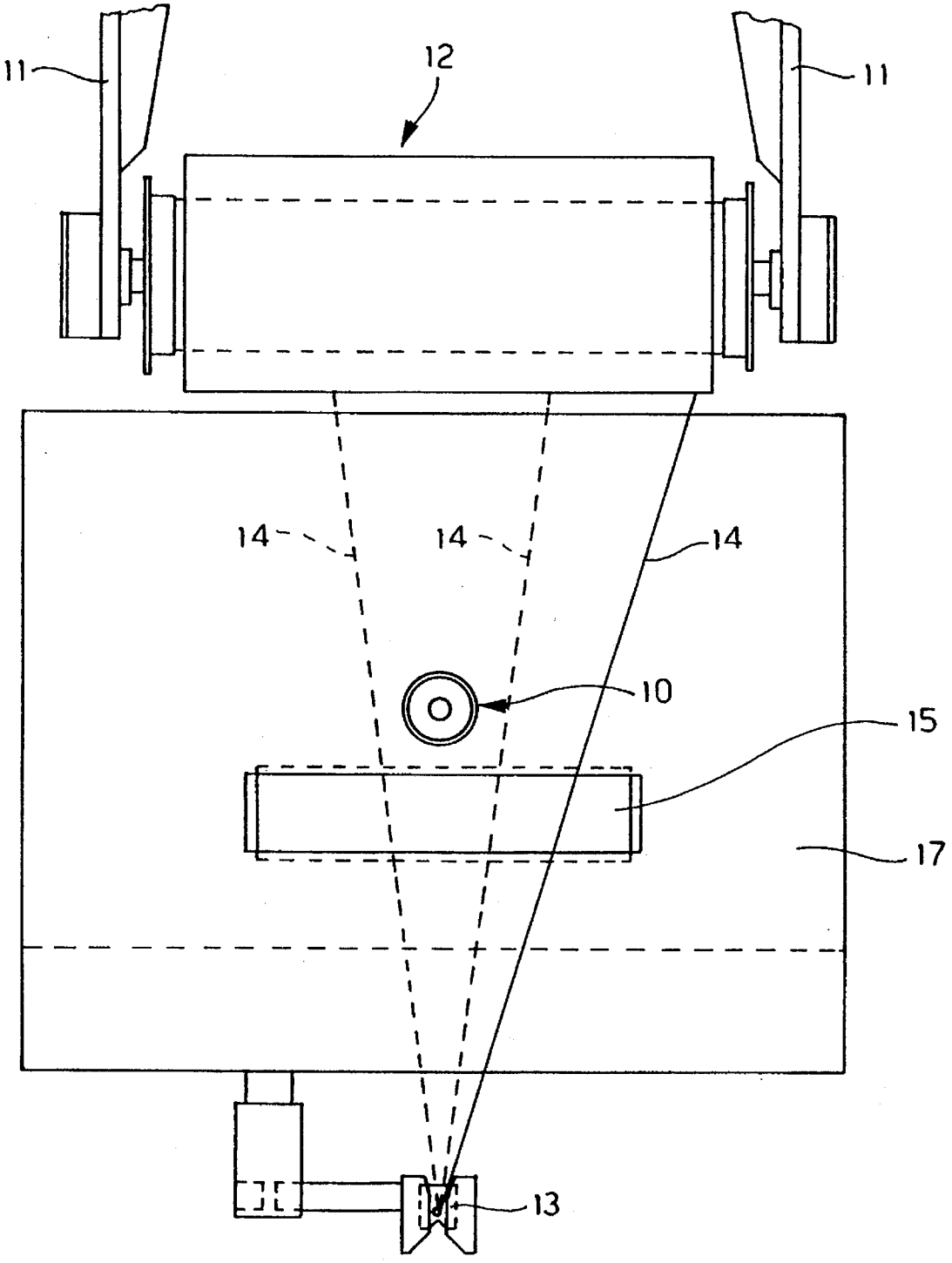
FIG. 2 represents a view from above of the textile machine of FIG. 1 in which the waving or oscillating movement of the yarn is shown in detail.
Figure 3:
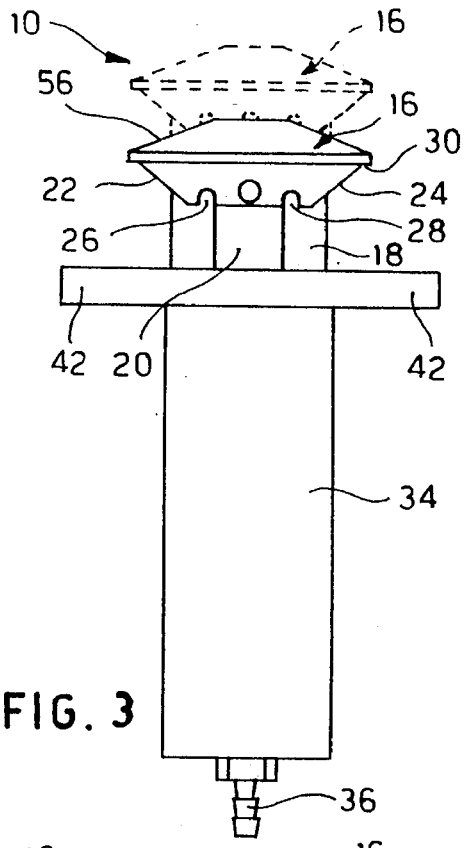
FIG. 3 represents a front elevation view of the preferred embodiment of the cutter of the present invention.
Figure 4:
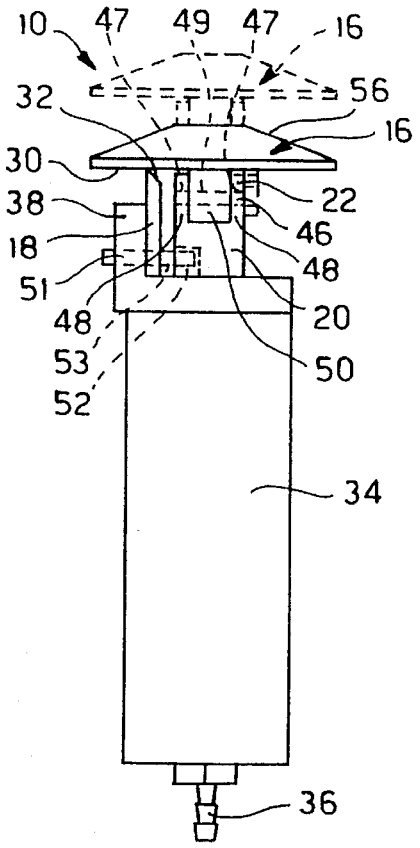
FIG. 4 is a side elevation view of the preferred embodiment of the cutter of the present invention.
Figure 5:
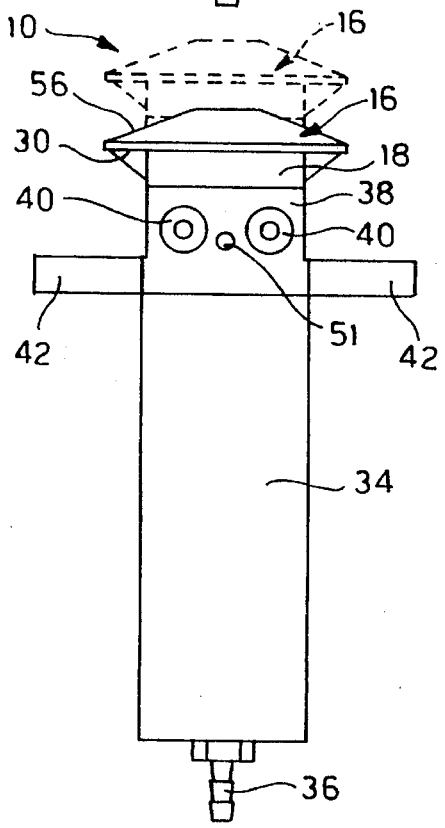
FIG. 5 is a rear elevation view of the preferred embodiment of the present invention.
Figure 6:
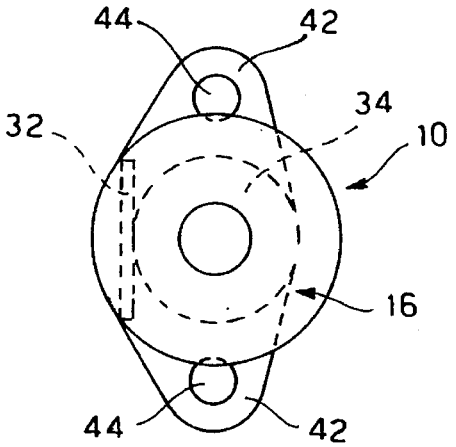
FIG. 6 is a view from above of the preferred embodiment of the cutter of the present invention.

FIGS. 1 and 2 show an application of the cutter 10 of the present invention to a textile machine, namely winding equipment.

Of the winding equipment the following are shown: the reel-holder arms 11 and the reel being wound 12 supported by them, a yarn drive element 13 and an oiling device 15 designed to apply lubricating oil to the yarn 14 which extends beyond the bench 17 of the winding equipment.

The yarn 14, in a wholly conventional manner, is drawn crosswise by mobile parts (not shown in the accompanying drawings) for guiding the yarn being wound. Said guide parts move reciprocatingly along a line parallel to the axis of the reel and make the yarn 14 coming from the drive element 13 describe a fanning movement which is simplified in FIG. 2 by the successive positions of the yarn shown by a dotted line.

In said figures it is clear how the cutter 10, arranged in a suitable position of the textile machine, intercepts the yarn 14 which moves in an oscillating or waving manner thanks to an upward rise (shown by the dotted line in FIG. 1) which brings the upper portion of the cutter to interfere with the movement of the yarn.

With reference to the subsequent FIGS. 3, 4, 5 and 6, it is possible to see how the cutter of the present invention comprises a first cutting element 16 which is mobile and arranged above a second fixed cutting element 18.

The upper mobile cutting element 16 is supported by an underlying stem 20 which extends laterally to the latter and, as shown by the dotted line in the figures, is moved by the latter, on command of suitable drive means, upwards and away from said second fixed cutting element 18 and downwards, towards and against said second fixed cutting element 18 in order to cut the yarn.

As is clear, also with reference to FIGS. 1 and 2, in a raised position said central stem 20 forms an element suitable for intercepting the yarn whether it comes from one side of the cutter or from the opposite side.

According to the invention moreover, with the aim of restraining the intercepted yarn by said stem 20 to prevent it moving away in the case wherein the cutter is not immediately actuated, suitable means for restraining the intercepted yarn are provided.

The abovementioned means of restraining the yarn comprise a first tilted yarn guide surface 22 on one side of the stem 20 and a second tilted yarn guide surface 24 on the opposite side of the stem 20, with said second tilted guide surface 24 which is tilted in an opposite way to the first tilted guide surface 22.

The means for restraining the yarn comprise moreover a first groove 26 of the first tilted surface 22 and, on the opposite side, a second groove 28 for the second yarn guide surface 24; said grooves being suitable for receiving and restraining the yarn which is conveyed therein by means of the abovementioned tilted guide surfaces 22, 24. In fact, after the yarn in an oscillating motion has fallen inside one of said grooves 26, 28, the side walls thereof prevent it from moving away, providing the required restraint.

In the embodiment shown, said grooves are arranged at the end of the respective tilted surface between the latter and the stem 20 for supporting the upper mobile element 16, however any other arrangement of said grooves as also any other configuration of the guide surface and/or of said grooves, provided they are suitable for trapping and restraining yarn which moves crosswise thereto, can be foreseen for the present invention.

The upper mobile cutting element 16 is in the form of a circular plate and has an upper flat surface 30 whereto said stem 20 is attached in a substantially central position, which co-operates for cutting yarn with a cutting edge 32 of said second fixed cutting element 18.

Said second fixed cutting element 18 is in the form of a plate having an upper horizontal cutting edge 32 which is positioned vertically to the rear of said stem 20 for driving and supporting said first mobile cutting element 16.

According to the invention the abovementioned means for restraining the yarn are attached to said lower flat surface in order to extend below said mobile cutting element 16, in front of said stem 20, on the side opposite to the one whereon said fixed cutting element 18 is situated.

Said stem 20 for supporting said mobile cutting element 16 can be driven in any suitable way; advantageously according to the invention it is foreseen to support and drive said stem 20 by means of a piston (not shown) contained in a hollow cylinder 34 defining a chamber for a pressurised fluid.

In the FIGS. 36 denotes a tube for hooking a feed pipe of the pressurised fluid for driving the piston housed inside the cylinder 34 and the stem 20 connected to the latter.

According to an embodiment shown of the invention, the stem is therefore driven by means of a pressurised fluid acting in opposition to suitable elastic resistance means provided inside the cylinder. Nevertheless any other means of driving the stem, for example of a mechanical or electromagnetic type, can be foreseen for the present invention.

In order to provide a cutter forming a compact assembly which can be positioned and mounted easily in any textile machine, said cylinder extends above with a rear bracket 38 whereto said lower fixed cutting element is attached by means of screws 40 or in any other suitable manner.

The cylinder 34, for easy and suitable attachment of the cutter to the textile machine whereto it is coupled, in turn has upper attachment tabs 42 which extend laterally thereto and horizontally and which have suitable holes 44 for inserting suitable fastening screws 43 (as shown in FIG. 1). In order to enable perfect coupling of the portions which come into contact for cutting, the possibility is provided of adapting the arrangement of said upper mobile cutting element 16 to the configuration of the cutting edge 32 of said second fixed element 18, so as to allow easy assembly of the cutting elements without it being necessary to regulate the relative position of said cutting elements 16, 18 and avoiding also the risk of gaps forming between the cutting elements themselves wherein the yarn may be inserted and thus invalidate the cutting action.

In order to achieve the abovementioned object according to the invention the possibility has therefore been provided so that the mobile cutting element 16 can freely rotate in order to adapt to the shape of the cutting edge 32 of said fixed element 18. A pin 46 is provided for fixing said upper mobile element 16 to said stem 20 around which the upper cutting element 16 is free to rotate. Said pin 46 is inserted in respective holes 47, 47, 49 provided in arms 48, 48, 50 which extend, respectively, arms 48, 48 from the stem 20 and the arm 50 from the fiat surface 30 of the mobile cutting element 16.

Suitable means for guiding the movement of the stem 20 are also provided with the aim of preventing any rotation of said stem 20 involving incorrect orientation of the elements for restraining the yarn. The latter could in fact, if the rotation of the stem is considerable, hit against the lower cutting element 18 and cause failure of the cutter.

Said stem guide means 20 are in the form of a plug 51 which is inserted in an appropriate longitudinal spline 52 formed in the stem 20. They are advantageously provided on the exterior of the cylinder 34 which allows any type of cylinder available on the market to be used for manufacturing the cutter of the invention without this requiring special elements for guiding the stroke of the stem.

Said plug 51 is attached to the same bracket 38 for attaching said fixed cutting element 18 and, passing through a slot 53 provided below said cutting element 18, extends horizontally towards the stem 20 inside the spline 52.

Advantageously the upper face 56 of said upper mobile cutting element 16 has a tapering or convex shape in order to allow easy sliding, without any risk of remaining tangled, of a yarn which, when the upper mobile part of the cutter rises, passes in fact above it.

Briefly the functioning of the cutter of the invention is the following: in normal conditions of functioning of the textile machine whereto said cutter is related, the upper mobile cutting element 16 is maintained in a lowered position in contact with said lower fixed cutting element 18. When it is necessary to cut the yarn, suitable control means drive the passage of a pressurised fluid from a suitable source towards the cylinder 34 to drive the upward movement towards the raised position (shown by the dotted line in the figures) of said upper mobile element. In this raised position the cutter intercepts with the central stem 20 or with the guide surfaces 22, 24 the yarn 14 which moves in a transverse plane in relation to the cutter with an oscillating motion, and is then trapped and restrained by the grooves 26, 28 on the mobile element 16.

At this point the means of controlling the feed of the fluid to said piston drive rapidly and violently downwards the upper mobile element which, by bringing its lower flat surface 30 to hit against the cutting edge 32 of the fixed element, shears the yarn.

It is understood that what has been written and shown in the accompanying drawings with reference to the preferred embodiment of the cutter of the present invention has been given purely by way of a non-limiting example of the principle claimed.

What is claimed is:

1. A cutter for cutting yarn in a textile machine in which said yarn moves in the direction of a longitudinal line and also moves transversely relative to said longitudinal line to provide a transverse oscillating movement in a horizontal plane, the cutter comprising: a first mobile cutting element, a second lower fixed cutting element, a stem for supporting the first mobile cutting element and extending toward the second fixed cutting element, said stem and said first mobile cutting element being normally positioned beneath said horizontal plane in order to permit said transverse oscillating movement of the yarn, means for driving the stem and therefore the first mobile cutting element to an upper intercepting position and to a lower cutting position, wherein in said intercepting position, the stem extends away from the lower fixed cutting element to define means for intercepting the yarn during said transverse oscillating movement of the yarn in said horizontal plane, and in said lower cutting position, the stem is retracted toward the second fixed cutting element to cut the yarn.

2. A cutter as claimed in claim 1, wherein said first mobile cutting element has surfaces thereon that face said second fixed cutting element and that guide the yarn toward the stem.

3. A cutter as claimed in claim 2, wherein said surfaces are oppositely inclined on opposite sides of said stem in a direction toward said stem and said second fixed cutting element.

4. A cutter as claimed in claim 1, wherein said first mobile cutting element is mounted for rotation on and relative to said stem about an axis extending longitudinally of said stem.

5. A cutter as claimed in claim 1, said means for driving the stem comprise a cylinder, said stem having a longitudinal spline formed in said stem, and a guide plug carried by said cylinder and disposed in said spline to prevent rotation of said stem relative to said cylinder.

6. A cutter as claimed in claim 1, wherein said upper mobile cutting element has a truncated conical upper surface.

7. A cutter as calimed in claim 1, wherein said drive means comprises a drive cylinder.

8. A cutter as claimed in claim 7, wherein said second fixed cutting element is fixed to said cylinder.

* * * * *